US010109269B2

(12) United States Patent
Scherrer

(10) Patent No.: US 10,109,269 B2
(45) Date of Patent: Oct. 23, 2018

(54) HIGH AND LOW FREQUENCY SOUND ABSORPTION ASSEMBLY

(71) Applicant: Jean-Marc Scherrer, Riedisheim (FR)

(72) Inventor: Jean-Marc Scherrer, Riedisheim (FR)

( * ) Notice: Subject to any disclaimer, the term of this patent is extended or adjusted under 35 U.S.C. 154(b) by 0 days.

(21) Appl. No.: 15/121,408

(22) PCT Filed: Mar. 3, 2015

(86) PCT No.: PCT/FR2015/050509
§ 371 (c)(1),
(2) Date: Aug. 25, 2016

(87) PCT Pub. No.: WO2015/132521
PCT Pub. Date: Sep. 11, 2015

(65) Prior Publication Data

US 2016/0365079 A1 Dec. 15, 2016

(30) Foreign Application Priority Data

Mar. 4, 2014 (FR) ..... 14 51735

(51) Int. Cl.

| | |
|---|---|
| ***E04B 9/00*** | (2006.01) |
| ***G10K 11/168*** | (2006.01) |
| ***E04B 1/84*** | (2006.01) |
| ***G10K 11/172*** | (2006.01) |
| *E04B 9/04* | (2006.01) |

(52) U.S. Cl.
CPC ..... *G10K 11/168* (2013.01); *E04B 1/84* (2013.01); *E04B 9/001* (2013.01); *G10K 11/172* (2013.01); *E04B 2009/0492* (2013.01)

(58) Field of Classification Search
CPC ..... E04B 9/001; E04B 2001/8433; G10K 11/168
USPC ..... 181/30, 290, 291, 293
See application file for complete search history.

(56) References Cited

U.S. PATENT DOCUMENTS 1,754,411 A * 4/1930 Balduf ..... E04B 9/001 181/295
2,000,806 A * 5/1935 White ..... G10K 11/175 181/0.5
2,132,642 A * 10/1938 Parsons ..... E04B 1/86 138/DIG. 4
2,159,488 A * 5/1939 Parkinson ..... E04B 1/82 181/286

(Continued)

FOREIGN PATENT DOCUMENTS

EP 2 251 858 11/2010
EP 2 472 018 7/2012

(Continued)

OTHER PUBLICATIONS

International Apln. No. PCT/FR2015/050509 search report dated Jul. 20, 2015.

*Primary Examiner* — Jeremy Luks
(74) *Attorney, Agent, or Firm* — Bachman & LaPointe, P.C.

(57) ABSTRACT

A sound-absorption assembly comprises a tubular-shaped body having ends closed respectively by first and second microperforated tensioned flexible sheets and at least one planar diaphragm disposed inside the tubular body between the microperforated flexible sheets so as to delimit two spaces between said sheets.

10 Claims, 2 Drawing Sheets

(56) References Cited

U.S. PATENT DOCUMENTS

| | | | | | |
|---|---|---|---|---|---|
| 2,177,393 | A * | 10/1939 | Parkinson | E04B 1/82 | 181/284 |
| 2,966,954 | A * | 1/1961 | Sabine | E04B 9/001 | 181/289 |
| 3,253,675 | A * | 5/1966 | Baruch | E04B 9/001 | 181/289 |
| 6,367,581 | B1 * | 4/2002 | Marler | B66B 11/0226 | 181/295 |
| 6,617,002 | B2 * | 9/2003 | Wood | G10K 11/16 | 181/292 |
| 8,100,225 | B2 * | 1/2012 | Bartha | E04B 1/86 | 181/290 |
| 8,109,361 | B2 * | 2/2012 | Tsugihashi | F04B 39/0027 | 181/207 |
| 8,499,887 | B2 | 8/2013 | Gleine et al. | | |
| 2006/0131104 | A1 * | 6/2006 | Yamaguchi | B60R 13/08 | 181/293 |
| 2006/0289229 | A1 * | 12/2006 | Yamaguchi | G10K 11/172 | 181/290 |
| 2008/0062688 | A1 * | 3/2008 | Aeling | F21V 19/0025 | 362/241 |
| 2009/0250293 | A1 | 10/2009 | Gleine et al. | | |
| 2013/0148357 | A1 * | 6/2013 | Johnston | E04B 9/32 | 362/253 |
| 2015/0279345 | A1 * | 10/2015 | Mathur | G10K 11/162 | 181/294 |

FOREIGN PATENT DOCUMENTS

| | | | | |
|---|---|---|---|---|
| FR | 2867797 | A1 * | 9/2005 | F21V 21/38 |
| GB | 614404 | | 12/1948 | |
| WO | WO 2008017737 | A1 * | 2/2008 | E04B 1/8409 |

* cited by examiner

HIGH AND LOW FREQUENCY SOUND ABSORPTION ASSEMBLY

BACKGROUND

The invention relates to the field of false partitions, and in particular that of false ceilings and false walls. The invention relates more particularly to a sound-absorption assembly intended to be disposed in a room with a view to controlling the acoustic behaviour of the latter.

The sound-absorption assembly is intended in particular, but not exclusively, to be associated with a false partition provided inside a room.

Conventionally, false partitions are produced from frames able to be fixed to a wall or ceiling of a room and flexible sheets tensioned on these frames. Despite the increasing use thereof in various environments, false partitions produced with tensioned flexible sheets have a major drawback that is having poor acoustic properties. The tensioned sheets in fact reflect the sound waves, thus giving rise to a significant phenomenon of reverberation (or echo) of the sound waves.

In order to overcome this drawback, providing sound-absorption assemblies comprising flexible sheets provided with microperforations to increase the sound absorption and therefore to attenuate the reflection of the sound waves is known from the prior art. By way of example, the application WO 2008/07737 can be cited, which describes a sound-absorbent assembly comprising two tensioned sheets provided with microperforations extending substantially parallel to the wall to be covered.

The sound-absorption assemblies of the prior art do however have several drawbacks. First of all, the acoustic assemblies of the prior art are essentially effective for the absorption of sounds at frequencies above 1500 Hz (high frequencies). On the other hand they remain ineffective for absorbing sounds at low frequency (frequencies below 300 Hz). Moreover, the acoustic assemblies of the prior art are fixed directly to the partition to be covered. However, when they are already equipped with false partitions produced with tensioned flexible sheets, it is necessary to remove them in order to allow the installation of the sound-absorption assemblies. The absorption zones therefore remain limited to the number of microperforated sheets.

SUMMARY

The invention aims to remedy these problems by proposing a sound-absorption assembly offering satisfactory acoustic properties at both high and low frequencies while offering increased absorption capability compared with the sound-absorption assemblies of the prior art.

The invention also so aims to propose a sound-absorption assembly making it possible to illuminate the room in which it is placed and/or to offer an aesthetic rendition while ensuring acoustic installation of the room.

To this end, and according to a first aspect, the invention proposes a sound-absorption assembly comprising a tubular-shaped body having ends closed respectively by first and second microperforated tensioned flexible sheets, and at least one planar diaphragm disposed inside the tubular body, between the microperforated flexible sheets so as to delimit two spaces between said sheets.

Thus, through the microperforated sheets and a planar diaphragm and the arrangement of these elements with respect to one another, the sound-absorption assembly affords absorption of the high- and low-frequency sounds and offers a sound-absorption zone that is greater than that offered by the sound-absorption assemblies of the prior art.

Low frequencies means frequencies below 300 Hz and high frequencies above 1500 Hz.

Moreover, microperforations means perforations having a diameter of less than 5 millimeters.

According to an advantageous embodiment, the diaphragm is fixed to the body by means of vibration-damping means. This prevents the vibrations to which the diaphragm is subjected being damped by the damping means, thus preventing the acoustic assembly being subjected to vibrations.

Advantageously, the sound-absorption assembly comprises at least one tensioned internal flexible sheet interposed between at least one of the microperforated flexible sheets and the diaphragm. Depending on the use for which the acoustic assembly is intended, the internal flexible sheet may be either microperforated or devoid of any perforation.

Advantageously, the sound-absorption assembly comprises at least one panel of absorbent porous material or materials interposed between at least one of the flexible sheets (end sheets or internal sheet or sheets) and the diaphragm.

Advantageously, the sound-absorption assembly comprises luminous means provided in one of the spaces.

Advantageously, the diaphragm is a flexible metal plate.

Advantageously, the metal plate is disposed parallel to the flexible sheets (end sheets and internal sheet or sheets).

Advantageously, at least one of the flexible sheets (end sheets and internal sheet or sheets) is translucent.

The sound-absorption assembly is intended advantageously to be mounted on a false partition.

The invention also relates to an installation comprising a false partition and at least one sound-absorption assembly as previously described.

Preferably, said assembly is fixed to the false partition at a distance greater than or equal to a limit value. More particularly, it is a case of placing the acoustic assembly so as to dispose one of the microperforated flexible sheets at a distance greater than or equal to the limit value. The acoustic assembly thus offers a dual entrance for the sound waves, increasing the surface area of absorption of the waves and thus improving the sound insulation of the room in which the system is disposed. According to a particular embodiment, the limit value is around 2 centimeters.

BRIEF DESCRIPTION OF THE DRAWINGS

Other objects and advantages of the invention will emerge during the following description given with reference to the accompanying drawings, in which.

For more clarity, the identical or similar elements in the various embodiments are marked by identical reference signs in all the figures.

DETAILED DESCRIPTION

Figure 1:
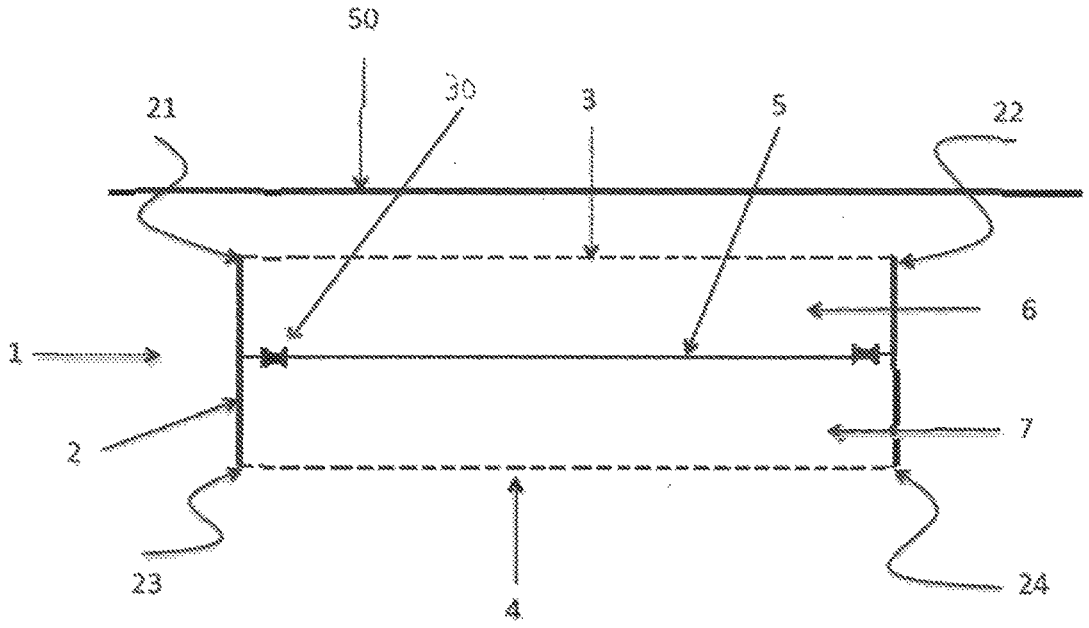
FIG. 1 depicts a schematic view in cross section of a sound-absorption assembly according to a first embodiment, said assembly being shown mounted on a false ceiling.

In relation to FIG. 1, a sound-absorption assembly 1 according to a first embodiment is described, said assembly being shown mounted on a false ceiling 50. In order to avoid burdening the figures, the means for fixing the sound-absorption assembly to the false ceiling have not been shown. They may comprise any suitable means known to persons skilled in the art such as for example hangers or more elaborate systems such as those described in the patent application FR 2867797.

The sound-absorption assembly 1 comprises a body 2 with a tubular shape (hereinafter referred to as chamber body 2) closed at its ends respectively by first and second microperforated tensioned flexible sheets 3, 4. End sheets 3, 4 will be spoken of hereinafter. The microperforated sheets 3, 4 are intended to absorb the high-frequency sounds.

In the embodiment described, the chamber body 2 has a parallelepipedal form. It is understood that the chamber body 2 is not limited to this form, it being able to adopt any other form without departing from the scope of the invention. To allow fixing of the end sheets 3, 4, the ends of the chamber body 2 are advantageously provided with fixing means used in a conventional manner for fixing tensioned sheets. According to a particular configuration, provision may be made for the chamber body 2 to be formed by a profiled member or a plurality of abutted profile members, each profiled member forming a rail for receiving the attachment means provided at the peripheral rim of the sheets.

The acoustic-absorption assembly 1 also comprises a planar diaphragm 5 absorbing the low-frequency sound. In the embodiment illustrated, the diaphragm is a flexible metal sheet 5. The latter is disposed inside the tubular body 2, between the end sheets, so as to delimit between said sheets two spaces 6, 7, preferably separate. In other words, the spaces 6, 7 do not communicate with each other. Advantageously, the metal plate 5 is disposed parallel to the end sheets 3, 4.

According to a particularly advantageous embodiment, the metal plate 5 is fixed to the chamber body 2 by means of a fixing system provided with vibration-damping means 30. The damping means consist of one or more parts produced from a flexible material so as to afford the absorption of vibrations between the metal plate 5 when the latter vibrates under the action of acoustic waves and the chamber body 2 supporting said plate. The metal plate 5 can thus vibrate and absorb the known frequencies without the acoustic assembly 1 also vibrating. By way of example, the damping means are Silentblocs®.

The metal plate 5 is advantageously situated at equal distances from the end sheets 3, 4.

The acoustic assembly 1 is mounted so as to have one of the end sheets 3, 4 facing the false ceiling 50, the chamber body 2 extending substantially perpendicular to the plane of the false ceiling 50. The acoustic assembly 1 is placed at a certain distance from the false ceiling 50 so as to duplicate the acoustically treated surfaces. This is because, by being placed at a certain distance from the false ceiling 50, the acoustic assembly 1 offers a top surface (corresponding to the end sheet 3) and a bottom surface (corresponding to the end sheet 4), both microperforated, absorbing the high-frequency sounds. So that the acoustic assembly 1 can thus serve as a double acoustic chamber, it is necessary to place the acoustic assembly 1 at a distance of at least 2 centimeters from the false ceiling. Hereinafter, the end sheet closest to the false ceiling 50 will be referred to as the top end sheet 3 and the end sheet situated furthest away from the false ceiling 50 will be referred to as the bottom end sheet 4.

Figure 2:
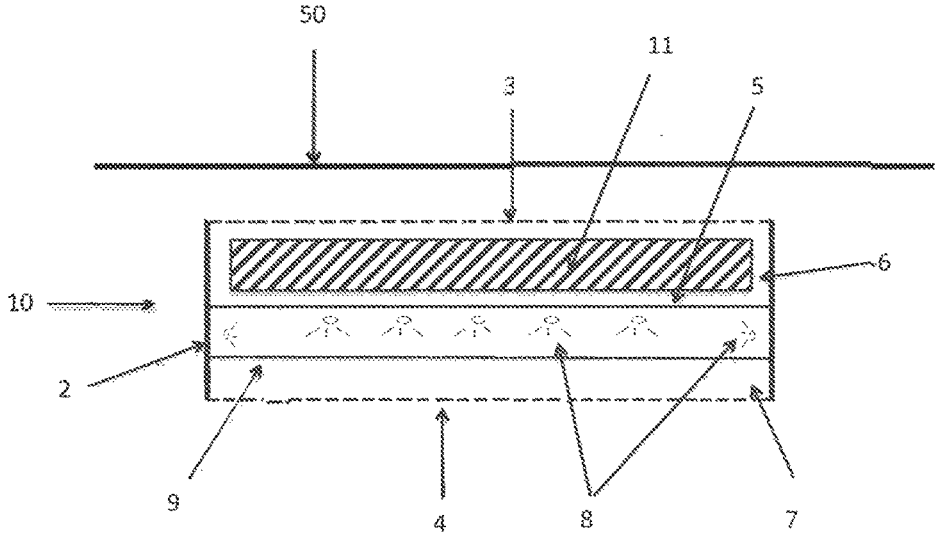
FIG. 2 shows a schematic view in cross section of a sound-absorption assembly according to a second embodiment, said assembly being shown mounted on a false ceiling.

In the embodiment illustrated in FIG. 2, the acoustic absorption assembly 10 repeats all the features of the previously described element.

The acoustic assembly 10 further comprises luminous means 8 provided in the lower space 7 (the space delimited between the metal plate 5 and the bottom metal plate 4). The luminous means 8 are fixed, directly or indirectly, to the bottom face of the metal plate 5, as well as to the partition portion of the chamber body 2 situated under the metal plate 5. It is of course obvious that the invention is not limited to this configuration, the luminous means 8 being able to be provided solely on the metal plate 5 or solely on the partition portion of the chamber body 2.

Advantageously, the acoustic assembly 10 comprises a flexible internal sheet 9 interposed between the bottom metal plate 4 and the metal plate 5. The internal sheet 9 has no perforation. Depending on the illuminating power of the luminous means 8, the internal sheet 9 will be translucent or not. The internal sheet 9 is disposed parallel to the end sheets 3, 4.

The acoustic assembly 10 further comprises a panel of sound-absorbent porous material or materials 11 interposed between the end sheet 3 and the metal plate 5. This thus improves the acoustic insulation. It is of course evident that, if the absorption assembly does not comprise any luminous means, a panel of absorbent porous material or materials 11 could also be provided in the bottom space 7 delimited by the metal plate 5 and the bottom end sheet 4, in replacement for or in addition to the one disposed in the top space 6. Moreover, in the embodiment illustrated, the panel of porous material or materials 11 is formed in a single piece and fills the whole of the top acoustic space. It is of course obvious that the panel of porous material or materials 11 could be formed by a plurality of layers of the same or different porous materials and could also have smaller dimensions, in particular in order to limit the weight of the acoustic assembly.

Figure 3:
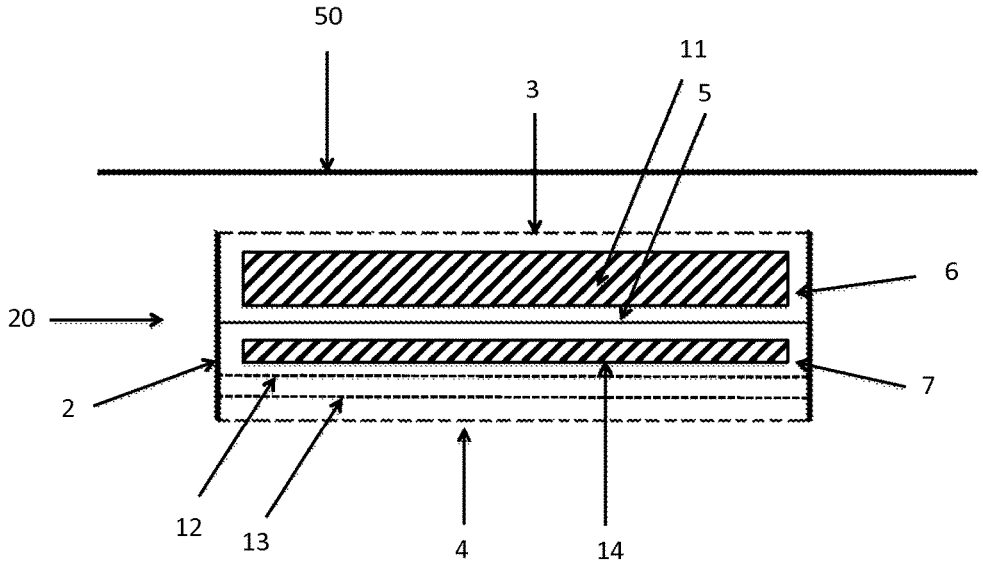
FIG. 3 shows a schematic view in cross section of a sound-absorption assembly according to a third embodiment, said assembly being shown mounted on a false ceiling.

In the embodiment illustrated in FIG. 3, the sound-absorption assembly 20 repeats all the features of the element described with reference to FIG. 1.

The sound-absorption assembly 20 further comprises two microperforated flexible internal sheets 12, 13, interposed between the bottom end sheet 4 and the metal plate 5. The internal sheets 12, 13 are disposed parallel to each other and to the metal plate 5. In order to improve the sound insulation, two panels of sound-absorbent porous material or materials 11, 14, one being interposed between the metal plate 5 and the adjacent internal layer 12, the other being interposed between the metal plate 5 and the top end sheet 3. It is of course obvious that the invention is not limited to this configuration. A sound-absorption assembly comprising only one or more than two acoustic (ie microperforated) internal sheets 12, 13 may be provided, these being able to be placed in one or other or both spaces 6, 7 delimited by the metal plate 5. Moreover, the absorption assembly 20 may be provided without a panel of absorbent porous material or materials or with only one, in this case disposed either in the top space 6 or in the bottom space 7. Moreover, in the embodiment illustrated, the panels of absorbent porous material or materials 11, 12 are formed in a single piece and fill all the acoustic spaces. It is of course obvious that the panels 11, 12 could be formed by a plurality of layers of the same or different absorbent material or materials and could also have smaller dimensions, in particular in order to limit the weight of the acoustic assembly.

In the embodiments described, the end sheets 3, 4 are shown disposed so as to lie in a plane containing the end edges 21, 22, 23, 24 of the chamber body 2. Provision may also be made for these end layers to be disposed at the ends of the chamber body 2 but in a plane slightly offset with respect to the plane passing through the end edges 21, 22, 23, 24 of the chamber body 2.

Moreover, in the embodiments previously described, the diaphragm chosen is a metal plate. It is of course obvious that the above description also applies to diaphragms other than a metal plate.

In the previously described embodiments, the false partition facing which the acoustic assembly is placed is a false ceiling, the assembly then forming an assembly suspended horizontally. It is of course obvious that the false partition facing which the acoustic assembly is placed may also be a wall, the acoustic assembly then forming an assembly suspended vertically. According to a particular embodiment, an acoustic assembly arranged so as to have one part intended to be placed facing the ceiling and another part placed facing a wall, the acoustic assembly then forming a horizontally and vertically suspended assembly, may also be provided.

Though the mounting of a single acoustic assembly on a false partition is described above, it will be understood clearly that an installation in which the false partition is equipped with a plurality of acoustic assemblies may be provided.

Moreover, in the embodiments described above, the acoustic assembly is associated with a false partition, and in this case a false ceiling. It is of course obvious that the acoustic assembly according to the invention could also be used directly on a ceiling or wall.

The invention is described above by way of example. Naturally a person skilled in the art is in a position to implement different variant embodiments of the invention without departing from the scope of the invention.

The invention claimed is:

1. A sound-absorption assembly comprising:

a tubular-shaped body having ends closed respectively by first and second microperforated tensioned flexible sheets and at least one low-frequency sound absorbing planar diaphragm disposed inside the tubular body, between the microperforated tensioned flexible sheets, so as to delimit two spaces between said sheets, said diaphragm being configured to be fixed to the body and maintained at a distance from the microperforated tensioned flexible sheets.

2. The sound-absorption assembly according to claim 1, wherein the diaphragm is fixed to the body by means of vibration-damping means.

3. The sound-absorption assembly according to claim 1, wherein said sound-absorption assembly comprises at least one internal flexible sheet interposed between at least one of the microperforated flexible sheets and the diaphragm.

4. The sound-absorption assembly according to claim 3, wherein the internal flexible sheet is microperforated.

5. The sound-absorption assembly according to claim 3, wherein the internal flexible sheet is devoid of perforation.

6. The sound-absorption assembly according to claim 5, wherein said sound-absorption assembly comprises at least one panel of absorbent porous material or materials interposed between at least one of the flexible sheets and the diaphragm.

7. The sound-absorption assembly according to claim 1, wherein said sound-absorption assembly comprises luminous means provided in one of the spaces.

8. The sound-absorption assembly according to claim 7, wherein the diaphragm is a flexible metal plate.

9. The sound-absorption assembly according to claim 8, wherein the metal plate is disposed parallel to the flexible sheets.

10. The sound-absorption assembly according to claim 9, wherein at least one of the flexible sheets is translucent.

* * * * *